United States Patent [19]

Kobler

[11] Patent Number: 4,892,297

[45] Date of Patent: Jan. 9, 1990

[54] COMBINATION SHEET FOLDING AND SELECTIVELY OPERABLE STAPLING APPARATUS

[75] Inventor: Ingo Kobler, Anhausen, Fed. Rep. of Germany

[73] Assignee: MAN Roland Druckmaschinen AG, Offenbach am Main, Fed. Rep. of Germany

[21] Appl. No.: 194,464

[22] Filed: May 16, 1988

[30] Foreign Application Priority Data

May 16, 1987 [DE] Fed. Rep. of Germany ..... 3716451

[51] Int. Cl.[4] ..... B41L 43/10

[52] U.S. Cl. ..... 270/38; 270/48; 270/49; 270/21.1

[58] Field of Search ..... 270/21.1, 5–9, 270/32, 37, 38, 60, 45, 47, 48–51; 493/428–432

[56] References Cited

U.S. PATENT DOCUMENTS

| | | | |
|---|---|---|---|
| 2,137,978 | 11/1938 | Mills | 270/37 |
| 4,147,337 | 4/1979 | Bolza-Schüneman | 270/48 |
| 4,344,610 | 8/1982 | Jeschke et al. | 270/47 |
| 4,381,106 | 4/1983 | Loebach | 270/47 |
| 4,491,310 | 1/1985 | Reffert | 270/60 |

FOREIGN PATENT DOCUMENTS

| | | | |
|---|---|---|---|
| 0046261 | 8/1981 | European Pat. Off. . | |
| 1157632 | 11/1963 | Fed. Rep. of Germany | 270/38 |
| 93771 | 7/1980 | Japan | 270/60 |

*Primary Examiner*—Randall L. Green
*Assistant Examiner*—Therese M. Newholm
*Attorney, Agent, or Firm*—Frishauf, Holtz, Goodman & Woodward

[57] ABSTRACT

To permit compact construction, a combination cylinder (3) having thereon cutting grooves for cooperation with cutting knives (5) of a cutting blade cylinder (4), grippers (7) and folding blades (8) receives a web or a plurality of superposed webs (2), to be cut into cut copy products or elements (17). The elements (17) are transferred to a collection cylinder (10), to be gripped by grippers (11) thereon and transferred to grippers (13) on a stapling head cylinder (12). The stapling head cylinder, if the stapling heads are energized, staples the webs together, and transfers them to grippers (7) on the combination cylinder which, in turn, folds the stapled sheets by operation of the folding blades thereon in association with folding jaws of a folding jaw cylinder (15) located adjacent the combination cylinder. The stapling head cylinder and the folding jaw cylinders are located, at least in part, laterally of the combination cylinder, so that the apparatus does not require substantial height. The stapling heads can be selectively operated, so that unstapled copy products likewise can be handled.

6 Claims, 1 Drawing Sheet

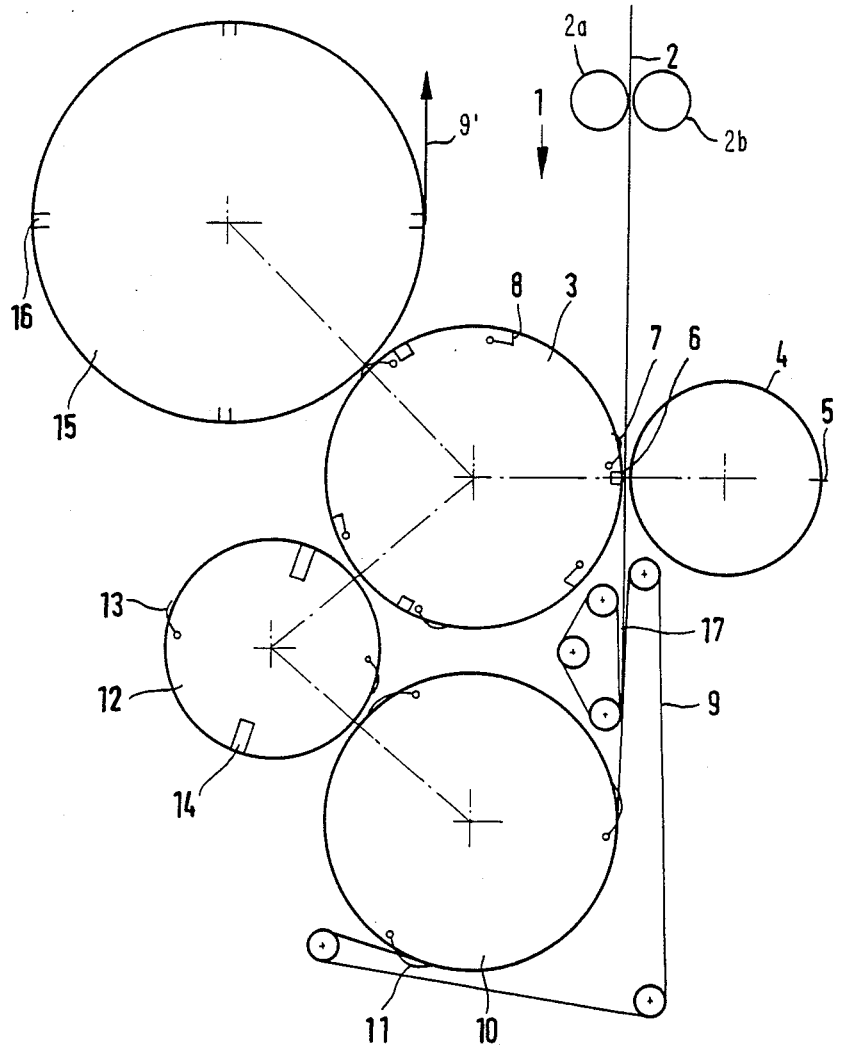
2a
2
1
2b
9'
16
15
8
3
7
6
4
5
13
12
14
17
9
11
10

COMBINATION SHEET FOLDING AND SELECTIVELY OPERABLE STAPLING APPARATUS

The present invention relates to paper handling apparatus, typically for association with printing machinery, and more particularly to a folding apparatus in which printed copy material can be folded and stapled, selectively, if desired.

BACKGROUND

Various types of folding - stapling-and collecting apparatus using rotary cylinders are known. A folding apparatus of this type is described in European Patent No. 00 46 261. This structure is comparatively high and thus can be used only in installations having high ceilings.

THE INVENTION

It is an object to provide a combination sheet folding apparatus which also, selectively, permits stapling of folded sheets and which is compact, that is, which is so low that it does not require especially high ceilings in a printing installation.

Briefly, a combination multifunction cylinder which has thereon a cutting groove for cooperation with a cutting blade cylinder, and folding blades for cooperation with a folding jaw cylinder, has a continuous web of a substrate, for example paper, supplied thereto, which web is cut by the cooperating cutting blade cylinder into sheets or substrate elements. These sheets or substrate elements are transported to a collection cylinder, typically supplied with grippers, which transfers the sheets to a stapling cylinder having sheet grippers thereon to receive the cut sheets and transfer them to the combination cylinder which, preferably, likewise has grippers thereon. The folding blade of the combination cylinder then folds the sheets which are transferred thereto and injects the folded edges of the sheets in the folding jaws of a folding jaw cylinder.

The apparatus has the advantage that a compact apparatus can be constructed using cylinders which do not have gripper pins or needles. This is particularly desirable if the copy products are not to have impressions or holes formed by the pick-up needles, that is, are free from puncture marks. Such puncture marks can be eliminated only by suitable cutting, which includes generation of paper scrap and requires additional working or operating steps.

Drawing, illustrating an illustrative embodiment:

The single FIGURE is a highly schematic side view of an arrangement in accordance with the invention, from which all matter not necessary for an understanding thereof has been omitted.

The folding-and-stapling apparatus 1 receives a substrate web 2. Typically, a plurality of such webs are superimposed; they are not shown separately in the drawing for clarity. The substrate, usually, is paper.

The substrate web or webs 2, typically paper, is or are preferably guided to the apparatus in a vertical direction by suitable guide rollers, *2a, 2b,* and as well known.

A combination multifunction cylinder 3,which is a combination cutting groove - gripper - folding blade cylinder, receives the web or webs 2, vertically tangentially. The combination cylinder 3 is formed with cutting grooves 6, and has grippers 7 as well as folding blades 8 thereon. The combination cylinder 3 is in operative association with a cutting blade cylinder 4, on which cutting blades 5 are located. The cutting blades 5 can engage in the cutting grooves 6 of the combination cylinder 3. The grooves 6 extend axially of the cylinder 3, as well known. Preferably, three groups, each, of grooves 6, grippers 7 and folding blades 8 are located on the circumference of the cylinder 3.

As cylinders 3 and 4 rotate, the web or webs 2 are cut into cut copy products or cut web elements 17. The cut web elements 17 are transported by a transport apparatus 9, preferably a belt system, to a collection cylinder 10. Collection cylinder 10, preferably, has grippers 11 located on the circumference thereof, as shown in the FIGURE. Preferably, three groups of grippers 11 are provided. The copy products 17 are received by the grippers 11 from the belt transport system 9 and are transferred to a combination transfer and stapling cylinder 12. The transfer and stapling cylinder 12 has grippers 13 and two diametrically positioned stapling devices 14 for insertion of staples, as well known in the field, such as, for example, stapling heads or the like. The cutting blade cylinder 4, likewise, has two diametrically located cutting blades 5 positioned thereon.

A plurality of superposed copy products 17, collected on the collection cylinder 10, can then be connected by stapling after transfer of the copy products 17 from the grippers 13 of the transfer and stapling cylinder 12 to the grippers 7 on the combination cylinder 3. The stapling heads 14 on the stapling cylinder 12 staple the groups of substrates which are then transferred to the combination cylinder 3, that is, between the cylinders 3 and 12.

Selectively, and if no stapling is necessary or desired, it is possible to operate the system without stapling, by merely disabling the stapling heads 14, so that the copy products 17 are guided, unstapled, about the cylinder 3. When an appropriate position of the copy products is reached opposite a folding jaw cylinder 15, the folding blades 8 on combination cylinder 3 form a fold and inject the folded edge into the folding jaws 16 of the folding jaw cylinder 15. The folding jaws 8 engage, as well known, in the folding jaws 16 of the folding blade cylinder 15. The now transversely folded copy products are then delivered from the folding jaw cylinder 15 to a further transport system schematically shown at 9', as well known, and can be transported further, for example, to a delivery apparatus, or further folding systems or apparatus.

As can be seen from the FIGURE, the arrangement is compact. The combination cylinder has a multiple function by first cooperating with the folding blade cylinder 4, then with the stapling head cylinder 12 and then, by virtue of the folding blades 8 thereon, with the folding jaw cylinder 15. This permits locating five cylinders in a compact configuration, in which the transfer and stapling cylinder 12 and the folding jaw cylinder 15 are positioned laterally with respect to the combination cylinder 3, and the collection cylinder 10 is positioned beneath the combination cylinder 3—assuming an initially essentially vertical path of the web.

The folding blades 8 on the combination cylinder 3, the blades 5 on the cutting cylinder 4, and the stapling heads 14 on the transfer and stapling cylinder 12, as well as the grippers on the respective cylinders and the jaws 16 on the folding jaw cylinder 15, can be operated, as well known, by suitable cams or other control mechanisms, in accordance with well known technology relating to control of accessory apparatus on rotating cylinders, particularly cylinders used in web and especially paper handling industries. The system is versatile since the stapling heads 14 may be engaged for stapling operation, or left idle, in which case the cylinder 12 will function merely as a transfer cylinder.

Various changes and modifications may be made within the scope of the inventive concept.

I claim:

1. Combination sheet handling apparatus for severing a web into sheets, for stapling the sheets and for folding the sheets, comprising the combination of a combination, multifunction cylinder (3) having at least one cutting groove (6), at least one folding blade (8) and at least one group of grippers (7) thereon;

a cutting blade cylinder (4) having cutting knife blades (5) thereon;

the cutting blade cylinder (4) being operatively associated with the combination cylinder (3);

means (*2a, 2b*) for guiding a substrate web, or a plurality of superposed substrate webs (2) between said operatively associated combination cylinder (3) and said cutting blade cylinder (4) to provide for cutting said web or webs and to furnish a sequence of cut substrate elements (17);

transport means (9) receiving the cut substrate elements from the combination cylinder (3);

a collection cylinder (10) having grippers (11) located thereon and receiving the cut sheets from said transport means (9);

a transfer and stapling cylinder (12), said transfer and stapling cylinder (12) having grippers (13) and stapling heads (14) thereon, said transfer and stapling cylinder receiving the cut substrate elements from the collection cylinder (10) gripping the cut substrate elements (17) with the grippers thereon and inserting staples therein;

a folding jaw cylinder (15) having folding jaws (16), operatively associated with the combination cylinder (3), wherein said transfer and stapling cylinder (12) is further operatively associated with the combination cylinder (3) for transfer of the cut substrate elements (17) on the grippers (13) on the transfer and stapling cylinder (12)

back to the combination cylinder (3), and on the grippers (7) thereon, and wherein the cutting grooves (6) on the combination cylinder, in cooperation with the operatively associated cutting blade cylinder (4) provides for cutting of the substrate web (2) into individual cut substrate elements (17) and for subsequent transfer to said transport means (9), and the folding blades (8) on the combination cylinder (3) provide for folding of the cut elements (17) transferred back thereto by the transfer and stapling cylinder (12) and for engagement into the folding jaws (16) of the folding jaw cylinder and consequent placement of the then folded cut elements (17) on the folding jaw cylinder (15).

2. The apparatus of claim 1, wherein said transport means (9) comprises a belt transport system.

3. The apparatus of claim 1, wherein the collection cylinder (10) is located below the combination cylinder (3).

4. The apparatus of claim 1, wherein the stapling cylinder (12) and the folding jaw cylinder (15) are, respectively, located, at least in part, laterally with respect to the combination cylinder (3).

5. The apparatus of claim 4, wherein the collection cylinder (10) is located below the combination cylinder (3).

6. The apparatus of claim 1, wherein a connection line joining the respective centers of rotation of the folding jaw cylinder (15), the combination cylinder (3), the transfer and stapling cylinder (12) and the collection cylinder (10), is, essentially of zig-zag configuration.

* * * * *